US011026517B2

(12) United States Patent
DeMoss et al.

(10) Patent No.: US 11,026,517 B2
(45) Date of Patent: Jun. 8, 2021

(54) MATTRESS ASSEMBLY WITH A MATTRESS TOPPER THAT INCLUDES POCKETED COIL SPRINGS AND METHODS OF PRODUCING THE SAME

(71) Applicant: Sealy Technology, LLC, Trinity, NC (US)

(72) Inventors: Larry K. DeMoss, Greensboro, NC (US); Brian M. Manuszak, Thomasville, NC (US); Darin T. Thomas, Salisbury, NC (US); Kevin Tar, Summerfield, NC (US)

(73) Assignee: Sealy Technology, LLC, Trinity, NC (US)

( * ) Notice: Subject to any disclaimer, the term of this patent is extended or adjusted under 35 U.S.C. 154(b) by 52 days.

(21) Appl. No.: 16/474,318

(22) PCT Filed: Dec. 29, 2016

(86) PCT No.: PCT/US2016/069254
§ 371 (c)(1),
(2) Date: Jun. 27, 2019

(87) PCT Pub. No.: WO2018/125153
PCT Pub. Date: Jul. 5, 2018

(65) Prior Publication Data
US 2019/0343294 A1 Nov. 14, 2019

(51) Int. Cl.
*A47C 27/05* (2006.01)
*A47C 27/06* (2006.01)
(Continued)

(52) U.S. Cl.
CPC ..... *A47C 27/053* (2013.01); *A47C 27/064* (2013.01); *A47C 27/14* (2013.01); *B68G 7/10* (2013.01); *B68G 9/00* (2013.01)

(58) Field of Classification Search
CPC ... A47C 27/053; A47C 27/064; A47C 27/056; A47C 27/22; B68G 7/10; B68G 9/00
See application file for complete search history.

(56) References Cited

U.S. PATENT DOCUMENTS 3,665,530 A 5/1972 Basner
3,774,250 A * 11/1973 Miller ..... B32B 5/026 5/737
(Continued)

FOREIGN PATENT DOCUMENTS

AU 2002337961 6/2003
AU 2004283189 A1 5/2005
(Continued)

OTHER PUBLICATIONS

Korean Intellectual Property Office, International Search Report and Written Opinion for PCT/US2016/069254 dated Sep. 22, 2017.
(Continued)

*Primary Examiner* — Nicholas F Polito
*Assistant Examiner* — Morgan J McClure
(74) *Attorney, Agent, or Firm* — Middleton Reutlinger

(57) ABSTRACT

A mattress assembly is provided that includes a mattress core having a bottom surface and a top surface opposite the bottom surface, and a mattress topper positioned adjacent to the top surface of the mattress core. The mattress topper includes a plurality of coil springs, an upper fabric layer extending above the plurality of coil springs, and a lower fabric layer extending below the plurality of coil springs. The lower fabric layer is connected to the upper fabric layer around each coil spring such that the upper fabric layer and the lower fabric layer collectively form a fabric pocket encasing each coil spring. The mattress topper further includes a padded layer positioned atop the upper fabric layer, with the padded layer connected to the upper fabric layer by ultrasonic welds and/or tufts. Methods of producing
(Continued)

a mattress topper for connection to a mattress core are further provided.

20 Claims, 4 Drawing Sheets

(51) Int. Cl.

| | |
|---|---|
| ***A47C 27/14*** | (2006.01) |
| ***B68G 7/10*** | (2006.01) |
| ***B68G 9/00*** | (2006.01) |

(56) References Cited

U.S. PATENT DOCUMENTS

| | | | | |
|---|---|---|---|---|
| 3,822,426 | A | 7/1974 | Mistarz | |
| 6,023,803 | A | 2/2000 | Barman | |
| 6,701,557 | B2 | 3/2004 | Barman | |
| D488,661 | S | 4/2004 | Barman et al. | |
| 6,721,982 | B2 | 4/2004 | Freeman | |
| 7,185,379 | B2 | 3/2007 | Barman | |
| 7,410,030 | B2 * | 8/2008 | Fusiki | G10K 11/168 181/286 |
| 9,861,206 | B2 | 1/2018 | Corodemus | |
| 9,936,815 | B2 | 4/2018 | DeMoss et al. | |
| 9,968,202 | B2 * | 5/2018 | Long | A47C 27/064 |
| 2003/0177583 | A1 | 9/2003 | Freeman et al. | |
| 2010/0115703 | A1 * | 5/2010 | Kluft | A47C 27/20 5/717 |
| 2011/0094039 | A1 | 4/2011 | Tervo et al. | |
| 2012/0284926 | A1 | 11/2012 | Tyree et al. | |
| 2015/0026893 | A1 | 1/2015 | Garrett et al. | |
| 2015/0342362 | A1 | 12/2015 | DeMoss et al. | |
| 2016/0235212 | A1 | 8/2016 | Krtek | |
| 2016/0316927 | A1 | 11/2016 | Thomas et al. | |
| 2016/0367042 | A1 | 12/2016 | Fisher | |
| 2020/0253382 | A1 * | 8/2020 | Long | A47C 21/046 |

FOREIGN PATENT DOCUMENTS

| | | | |
|---|---|---|---|
| AU | 2009342701 | A1 | 10/2010 |
| AU | 2016434431 | A1 | 6/2019 |
| BR | PI0214480 | | 5/2006 |
| BR | PI0415440 | A | 12/2006 |
| BR | PI0906740 | A2 | 7/2015 |
| BR | PI0906744 | A2 | 7/2015 |
| CA | 946987 | | 5/1974 |
| CA | 2465578 | | 6/2003 |
| CA | 2539008 | A1 | 5/2005 |
| CA | 3046626 | A1 | 7/2018 |
| CN | 1964650 | A | 5/2007 |
| CN | 110139583 | A | 8/2019 |
| DE | 2354618 | | 5/1974 |
| DK | 2373199 | | 9/2014 |
| EP | 1448081 | | 8/2004 |
| EP | 2373199 | | 6/2014 |
| EP | 3562351 | A1 | 11/2019 |
| FR | 2205813 | | 5/1974 |
| GB | 1423048 | | 1/1976 |
| JP | H11244098 | A | 9/1999 |
| JP | 2014-504934 | A | 2/2014 |
| JP | 2020503931 | A | 2/2020 |
| KR | 1020070026321 | A | 3/2001 |
| KR | 101508725 | B1 | 4/2015 |
| MX | PA04005166 | | 8/2004 |
| MX | PA06004139 | A | 6/2006 |
| MX | 2019007775 | A | 9/2019 |
| WO | 03047394 | | 6/2003 |
| WO | 03082054 | | 10/2003 |
| WO | 2005039849 | A2 | 5/2005 |
| WO | 2013106066 | | 7/2013 |
| WO | 2014166927 | | 10/2014 |
| WO | 2017116405 | A1 | 7/2017 |
| WO | 2018118037 | A1 | 6/2018 |
| WO | 2018125153 | | 7/2018 |
| ZA | 201903847 | B | 12/2020 |

OTHER PUBLICATIONS

European Patent Office, European Search Report for EP16925787.0 dated Apr. 21, 2020, 8 pages.

Japenese Patent Office, Notice of Reasons for Refusal for JP 2019-535320 dated Nov. 17, 2020, 5 pages. (English translation).

* cited by examiner

MATTRESS ASSEMBLY WITH A MATTRESS TOPPER THAT INCLUDES POCKETED COIL SPRINGS AND METHODS OF PRODUCING THE SAME

TECHNICAL FIELD

The present invention relates to mattress assemblies having a mattress topper. In particular, the present invention includes mattress assemblies with a mattress topper that has a plurality of integrated pocketed coil springs and that is positioned atop a mattress core.

BACKGROUND

Mattress toppers are oftentimes connected to a mattress core to form the uppermost support surface of a traditional innerspring mattress assembly. These mattress toppers generally consist of one or more layers of textiles, foam, and/or fiber fill which are bonded together, typically by sewing a quilted pattern through the layers. As such, mattress toppers therefore provide additional padding between the innerspring mattress core and the body of a user positioned on the mattress assembly. However, the foam and/or fiber fill used in mattress toppers can lose resilience over time, which commonly leads to an indentation where a user's body lays on the uppermost support surface of the mattress. Such an indentation is not only unattractive, but it also provides the user with less cushioning and support, which can lead to poor sleep quality and/or having to replace the mattress entirely. Accordingly, a mattress topper that provides better cushioning and support throughout the life of the mattress would be both highly desirable and beneficial.

SUMMARY

The present invention includes a mattress assembly having a mattress topper. In particular, the present invention includes mattress assemblies with a mattress topper that has a plurality of integrated pocketed coil springs and that is positioned atop a mattress core.

In one exemplary embodiment of the present invention, a mattress assembly is provided that includes a mattress core and a mattress topper positioned atop the mattress core. The mattress topper includes a plurality of coil springs arranged in a matrix, an upper fabric layer extending above the plurality of coil springs, and a lower fabric layer extending below the plurality of coil springs with the lower fabric layer connected to the upper fabric layer around each coil spring such that the upper fabric layer and the lower fabric layer collectively form a fabric pocket encasing each coil spring. Specifically, the lower fabric layer is typically connected to the upper fabric layer in between each of the coil springs by an ultrasonic weld.

The exemplary mattress topper further includes a padded layer positioned atop the upper fabric layer. The padded layer is configured to provide a sufficiently soft surface upon which a portion of a user's body can rest, and as such, the padded layer is comprised of a visco-elastic foam, a fibrous material, or both a visco-elastic foam and a fibrous material. Regardless of the particular material which the padded layer is comprised of, however, in the exemplary mattress topper, the padded layer is connected to the upper fabric layer. The exemplary mattress topper further includes a textile layer positioned atop and connected to the padded layer as well as a backing layer positioned below and connected to the lower fabric layer. In one embodiment of the present invention, the padded layer, textile layer and backing layer are connected to the respective underlying layers by an adhesive.

In another embodiment of the present invention, the backing layer, padded layer, and textile layer are all connected by the same ultrasonic weld that connects the lower fabric layer to the upper fabric layer. In particular, not only is the upper fabric layer connected to the lower fabric layer by the ultrasonic weld, but the backing layer is connected to the lower fabric layer by the ultrasonic weld, the padded layer is connected to the upper fabric layer by the ultrasonic weld, and the textile layer is connected to the padded layer by the ultrasonic weld. The backing layer, the lower fabric layer, the upper fabric layer, the padded layer, and the textile layer are brought together between each of the coil springs and connected by the ultrasonic weld such that each of the coil springs is completely surrounded by a respective ultrasonic weld, as further discussed below.

In yet other embodiments of the present invention, the backing layer, the lower fabric layer, the upper fabric layer, the padded layer, and the textile layer are connected by a plurality of tufts that extend through all of the layers of the mattress topper. In particular, in this exemplary mattress topper, the plurality of coil springs are arranged in a rectangular matrix with a tuft positioned at an intersection point equidistant to four adjacent coil springs such that each coil spring is bordered by four tufts which connect all of the layers of the mattress topper around each coil spring to collectively form a fabric pocket encasing the coil spring.

In one exemplary implementation of a method for producing the mattress toppers described herein, an array of coils is first provided and positioned between an upper fabric layer and a lower fabric layer. After positioning the array of coil springs between the upper fabric layer and the lower fabric layer, the lower fabric layer is then connected to the upper fabric layer between each of the coil springs. In some embodiments, the lower fabric layer is connected to the upper fabric layer by ultrasonically welding the lower fabric layer to the upper fabric layer. As would be recognized by those of skill in the art, such ultrasonic welds are formed by compressing the fabric layers together between two irons and then running an electric current through the irons to melt the material of the two fabric layers together. In one exemplary embodiment, the lower fabric layer is ultrasonically welded to the upper fabric layer by compressing the fabric layers between two substantially circular irons which fit around each coil spring such that the irons simultaneously form an ultrasonic weld that completely surrounds the respective coil spring.

After connecting the lower fabric layer to the upper fabric layer, a padded layer is then connected to the upper fabric layer. In some implementations of the methods of the present invention, the padded layer is connected to the upper fabric layer by an adhesive. In some other implementations of the methods of the present invention, the padded layer is connected to the upper fabric layer with an ultrasonic weld. In still other implementations of the methods of the present invention, the padded layer is connected to the upper fabric layer by forming a plurality of tufts that extend through the lower fabric layer, the upper fabric layer, and the padded layer.

Further features and advantages of the present invention will become evident to those of ordinary skill in the art after a study of the description, figures, and non-limiting examples in this document.

DESCRIPTION OF EXEMPLARY EMBODIMENTS

The present invention includes a mattress assembly having a mattress topper. In particular, the present invention includes mattress assemblies with a mattress topper that has a plurality of integrated pocketed coil springs and that is positioned atop a mattress core.

Figure 1:
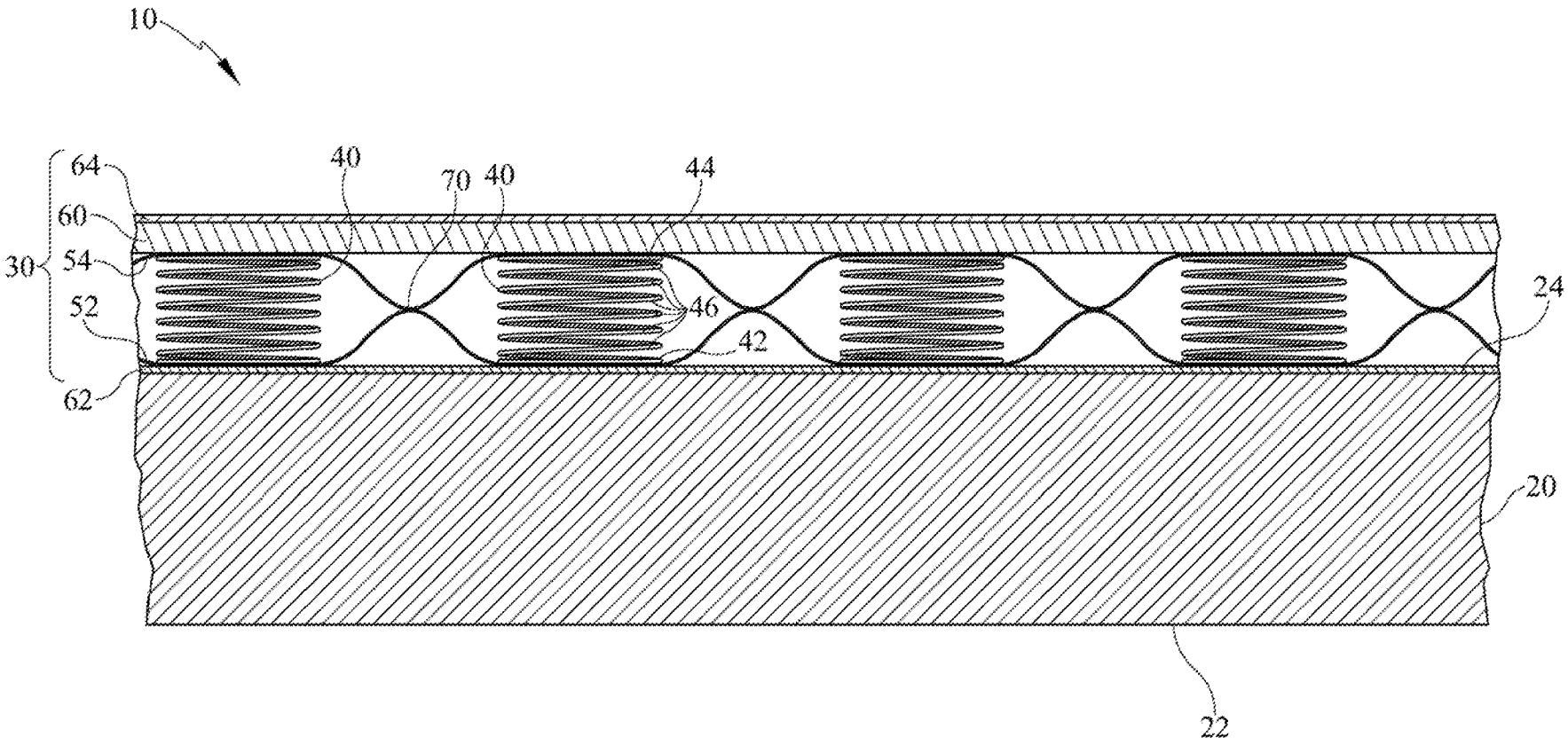
FIG. 1 is a side sectional view of an exemplary mattress assembly made in accordance with the present invention and including a mattress topper.

Referring first to FIG. 1, in one exemplary embodiment of the present invention, an exemplary mattress assembly 10 is provided that includes a mattress core 20 and a mattress topper 30 positioned atop the mattress core 20. In particular, the mattress core 20 has a bottom surface 22 and a top surface 24 opposite the bottom surface 22, and the mattress topper 30 is positioned adjacent to the top surface 24 of the mattress core 20.

The mattress topper 30 includes a plurality of coil springs 40 arranged in a matrix, an upper fabric layer 54 extending above the plurality of coil springs 40, and a lower fabric layer 52 extending below the plurality of coil springs 40. The lower fabric layer 52 is connected to the upper fabric layer 54 around each coil spring 40 such that the upper fabric layer 54 and the lower fabric layer 52 collectively form a fabric pocket encasing each coil spring 40.

With respect to each of the coil springs 40 and referring still to FIG. 1, each exemplary coil spring 40 shown in FIG. 1 is made of a continuous wire that extends from a lower end convolution 42 to an upper end convolution 44 opposite the lower end convolution 42. In the coil spring 40, there are six intermediate convolutions 46 that helically spiral between the lower end convolution 42 and the upper end convolution 44, such that the coil spring 40 is made of a total of eight convolutions or turns. Furthermore, each of the coil springs 40 has a height defined from the lower end convolution 42 to the upper end convolution 44 with each of the convolutions of the coil spring 40 having a diameter. The height of the coil spring 40 can range from about one-half (½) inches to about three (3) inches and the diameter of each of the convolutions of the coil spring 40 can range from about three-fourths (¾) inches to about three (3) inches. In the particular embodiment shown in FIG. 1, the height of the coil springs 40 is about seven-eighths (⅞) inches and the diameter of each of the convolutions is about one and one-fourth (1¼) inches. Of course, various other springs, such as coil springs having a different number of convolutions, different height, and/or different diameter, could also be used in an exemplary pocket coil spring assembly without departing from the spirit and scope of the present invention.

With respect to the upper fabric layer 54 and the lower fabric layer 52 and referring still to FIG. 1, the lower fabric layer 52 is connected to the upper fabric layer 54 in between each of the coil springs 40 about midway up the height of the coil springs 40. In this regard, the upper fabric layer 54 and the lower fabric layer 52 shown in FIG. 1 are generally made of a non-woven textile which are joined together by an ultrasonic weld 70 to form such a structure. For example, suitable fabrics that can be used for the upper fabric layer 54 and the lower fabric layer 52 can include one of various thermoplastic fibers known in the art, such as non-woven polymer-based fabric, non-woven polypropylene material, or non-woven polyester material. Of course, the lower fabric layer 52 can be connected to the upper fabric layer 54 by any number of means, including a tuft, a staple, stitches, clamps, hook-and-loop fasteners, and the like. Regardless of the particular method of connecting the upper fabric layer 54 and the lower fabric layer 52, however, by connecting the upper fabric layer 54 and the lower fabric layer 52 around each coil spring 40, not only is it possible to impart a desired level of pre-compression, stability, and/or stretchability to the coil spring 40, but each of the coil springs 40 is able to compress at least partially independently of the other coil springs 40 while still being held in position relative to the other coil springs 40, as further discussed below.

Referring still to FIG. 1, the exemplary mattress topper 30 further includes a padded layer 60 positioned atop the upper fabric layer 54. The padded layer 60 is configured to provide a sufficiently soft surface upon which a portion of a user's body can rest, and as such, the padded layer 60 is typically comprised of a visco-elastic foam, a fibrous material, or both a visco-elastic foam and a fibrous material. In the case of the padded layer 60 comprising a flexible foam, such flexible foams include, but are not limited to, latex foam, reticulated or non-reticulated visco-elastic foam (sometimes referred to as memory foam or low-resilience foam), reticulated or non-reticulated non-visco-elastic foam, polyurethane high-resilience foam, expanded polymer foams (e.g., expanded ethylene vinyl acetate, polypropylene, polystyrene, or polyethylene), and the like. In the embodiment shown in FIG. 1, the padded layer 60 of the mattress topper 30 is comprised of visco-elastic foam. Generally, such visco-elastic foam has a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 2439 hardness measuring standard. In some embodiments, the visco-elastic foam has a hardness of about 10 N, about 20 N, about 30 N, about 40 N, about 50 N, about 60 N, about 70 N, or about 80 N to provide a desired degree of comfort and body-conforming qualities.

The visco-elastic foam described herein for use in the padded layer 60 can also have a density that assists in providing a desired degree of comfort and body-conforming qualities, as well as an increased degree of material durability. In some embodiments, the density of the visco-elastic foam used in the padded layer 60 of the mattress topper 30 has a density of no less than about 30 kg/m$^3$ to no greater than about 150 kg/m$^3$. In some embodiments, the density of the visco-elastic foam used in the padded layer 60 of the mattress topper 30 is about 30 kg/m$^3$, about 40 kg/m$^3$, about 50 kg/m$^3$, about 60 kg/m$^3$, about 70 kg/m$^3$, about 80 kg/m$^3$, about 90 kg/m$^3$, about 100 kg/m$^3$, about 110 kg/m$^3$, about 120 kg/m$^3$, about 130 kg/m$^3$, about 140 kg/m$^3$, or about 150 kg/m$^3$. Of course, the selection of a visco-elastic foam having a particular density will affect other characteristics of the foam, including its hardness, the manner in which the foam responds to pressure, and the overall feel of the foam, but it is appreciated that a visco-elastic foam having a desired density and hardness can readily be selected for a particular application or mattress topper as desired.

As mentioned above, the padded layer 60 need not be comprised of flexible foam at all, but can alternatively be comprised of a fibrous material. Such a fibrous material can include natural fibers, such as cotton or silk fibers, synthetic fibers, such as polyester fibers, or combinations thereof. Furthermore, in some embodiments, the padded layer 60 is comprised of a plurality of layers with each layer being made of a visco-elastic foam, a fibrous material, or both a visco-elastic foam and a fibrous material.

Regardless of the particular material that the padded layer 60 is comprised of, in the exemplary mattress topper 30, the padded layer 60 is connected to the upper fabric layer 54. More specifically, in the mattress topper 30 shown in FIG. 1 the padded layer 60 is connected to the upper fabric layer 54 by an adhesive which allows the padded layer 60 to extend across the plurality of coil springs 40 with the padded layer 60 staying substantially flat such that the mattress topper 30 is a smooth top mattress topper, as further discussed below.

As also shown in FIG. 1, the exemplary mattress topper 30 further includes a textile layer 64 positioned atop the padded layer 60 and which is also connected to the padded layer 60 by an adhesive. In the embodiment shown in FIG. 1, the textile layer 64 is the uppermost layer of the mattress topper 30 and so the textile layer 64 is comprised of a material which is resilient to wear, while still providing a comfortable top surface on which to rest. Such materials can be comprised of natural fibers, such as cotton or silk fibers, synthetic fibers, such as polyester fibers, or combinations thereof. Furthermore, although not expressly shown, it is contemplated that the textile layer 64 can include a decorative pattern on its top surface, such as a quilted pattern, as desired.

Referring still to FIG. 1, the exemplary mattress topper 30 further includes a backing layer 62 positioned below the lower fabric layer 52 and which is connected to the lower fabric layer 52 by an adhesive. In the embodiment shown in FIG. 1, the backing layer 62 is comprised of a non-woven textile such as non-woven polymer-based fabric, non-woven polypropylene material, or non-woven polyester material, but the backing layer can be comprised of a variety of other materials as well without departing from the spirit and scope of the present invention.

As mentioned above, the exemplary embodiment shown in FIG. 1 is a smooth top mattress topper 30 in which the padded layer 60 extends substantially flat across the plurality of coil springs 40. By comparison, in another embodiment of the present invention, and referring now to FIGS. 2 and 3, the padded layer 160 is configured such that it rises and falls across the plurality of coil springs 140, thereby forming a pattern across the mattress topper 130 and such that the mattress topper 130 is in the form of a quilted top mattress topper. Specifically, as perhaps best shown in FIG. 2, a mattress assembly 110 is provided that includes a mattress core 120 having a bottom surface 122 and a top surface 124 opposite the bottom surface 122, and a mattress topper 130 positioned adjacent to the top surface 124 of the mattress core 120. Similar to the mattress topper 30 described above with respect to FIG. 1, the mattress topper 130 shown in FIG. 2 includes a plurality of coil springs 140 arranged in a matrix, an upper fabric layer 154 extending above the plurality of coil springs 140, and a lower fabric layer 152 extending below the plurality of coil springs 140. The lower fabric layer 152 is connected to the upper fabric layer 154 by an ultrasonic weld 170 around each coil spring 140, such that the upper fabric layer 154 and the lower fabric layer 152 collectively form a fabric pocket encasing each coil spring 140. Furthermore, the mattress topper 130 also includes a backing layer 162 positioned below the lower fabric layer 152, a padded layer 160 positioned atop the upper fabric layer 154, and a textile layer 164 positioned atop the padded layer 160, which are each substantially similar to the backing layer 62, padded layer 60, and textile layer 64 shown in FIG. 1, except that the backing layer 162, padded layer 160, and textile layer 164 in the exemplary embodiment shown in FIGS. 2 and 3 are all connected by the same ultrasonic weld 170 that connects the lower fabric layer 152 to the upper fabric layer 154.

Figure 2:
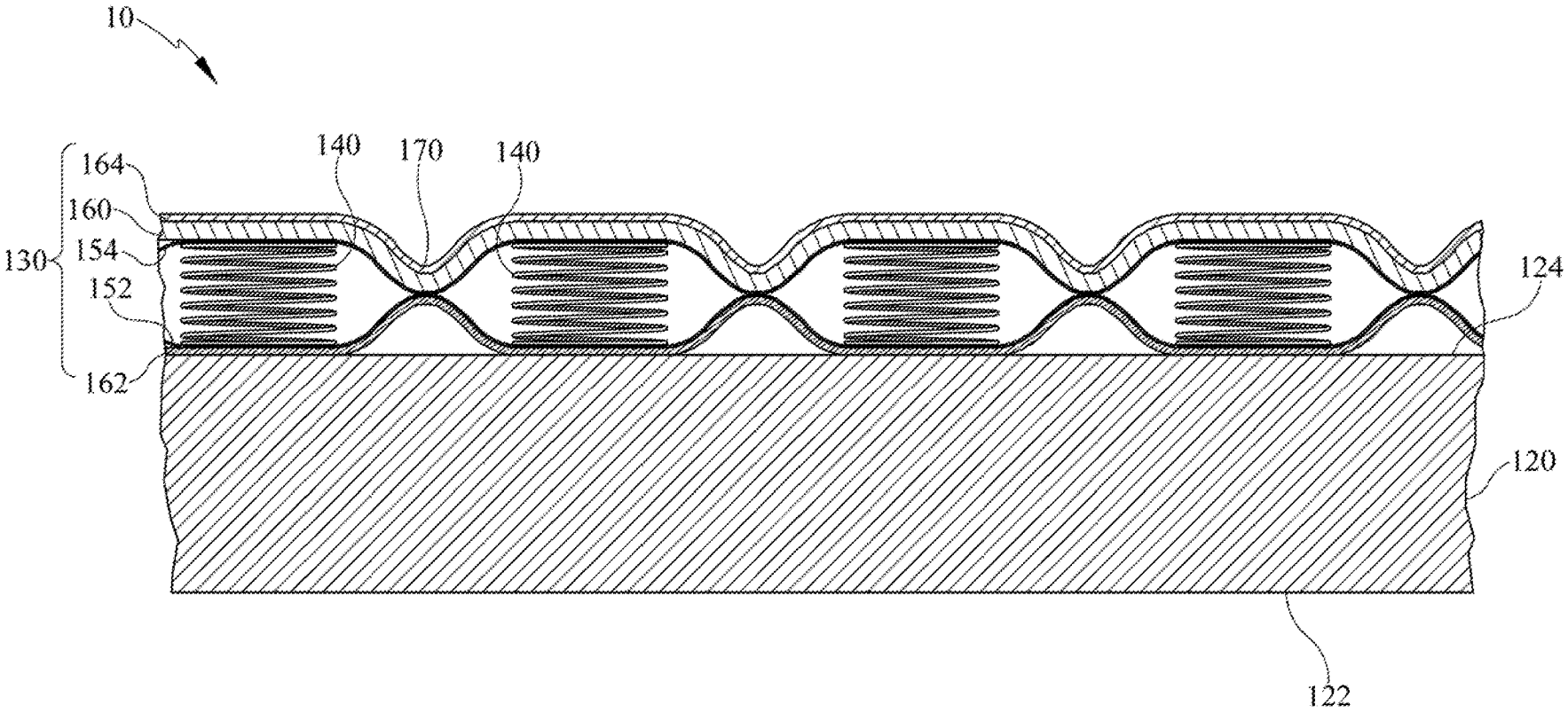
FIG. 2 is a side sectional view of another exemplary mattress assembly made in accordance with the present invention and including a mattress topper.

In particular, as shown in FIG. 2, not only is the upper fabric layer 154 connected to the lower fabric layer 152 by the ultrasonic weld 170, but the backing layer 162 is connected to the lower fabric layer by the ultrasonic weld 170, the padded layer 160 is connected to the upper fabric layer 154 by the ultrasonic weld 170, and the textile layer 164 is connected to the padded layer 160 by the ultrasonic weld 170. Each of the layers of the mattress topper 130 (i.e., the backing layer 162, the lower fabric layer 152, the upper fabric layer 154, the padded layer 160, and the textile layer 164) are brought together between each of the coil springs 140 and connected about midway up the height of the coil springs 140. Furthermore, as shown in FIG. 3, each of the coil springs 140 is completely surrounded by a respective ultrasonic weld 170, as further discussed below. Accordingly, the padded layer 160 and overlaying textile layer 164 rise and fall across the plurality of coil springs 140 such that, as described above, the mattress topper 130 is a quilted top mattress topper.

Figure 3:
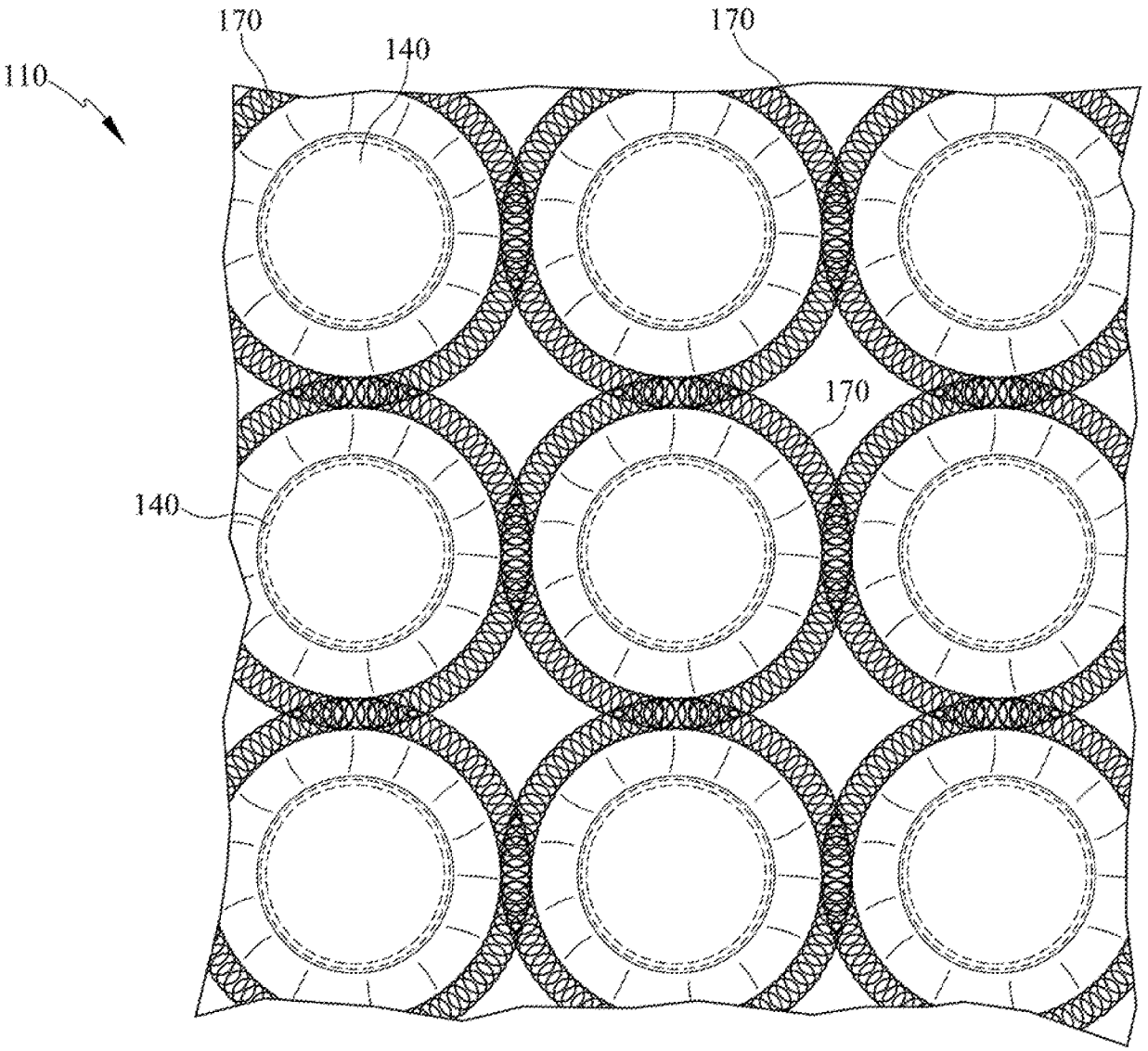
FIG. 3 is a partial top view of the mattress assembly of FIG. 2 showing ultrasonic welds around each of a plurality of coil springs arranged in a matrix.

As shown in FIG. 3, the coil springs 140 and ultrasonic welds 170 are positioned such that one substantially circular ultrasonic weld 170 surrounding one coil spring 140 overlaps with another ultrasonic weld 170 surrounding another adjacent coil spring 140. Furthermore, since the ultrasonic welds 170 shown in FIG. 3 are substantially circular, the ultrasonic welds 170 only partially overlap with each other. It is, of course, contemplated though that increasing the spacing of the coil springs 140 or changing the size and/or shape of the ultrasonic welds would result in different patterns of the ultrasonic welds that could be produced without departing from the spirit and scope of the present invention.

Figure 4:
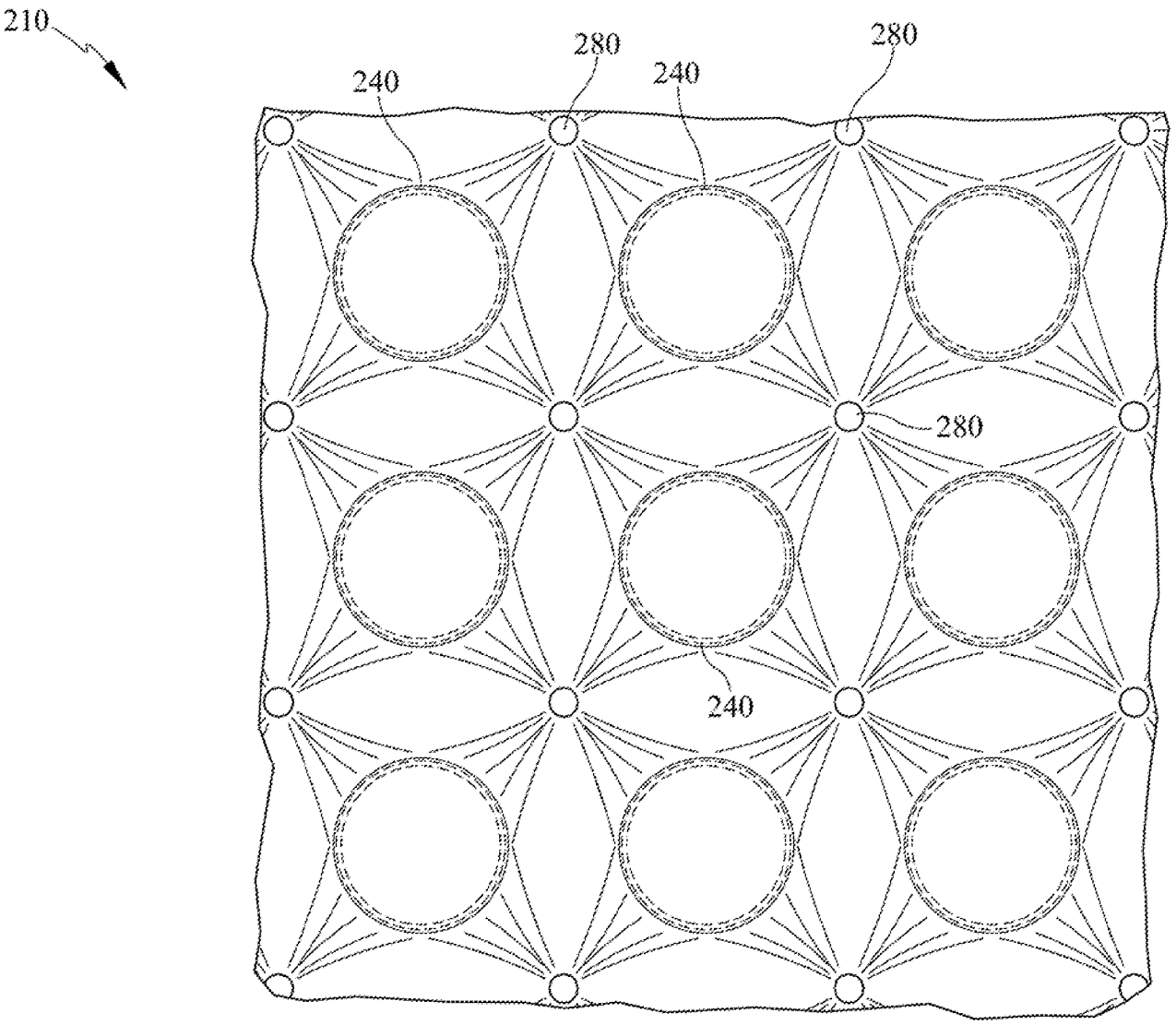
FIG. 4 is a partial top view of another mattress assembly showing a plurality of tufts between each of a plurality of coil springs arranged in a matrix.

Referring now to FIG. 4, in another embodiment of the present invention that includes a mattress topper, rather than connecting all of the layers of the mattress topper with an ultrasonic weld, in the mattress topper 230 shown in FIG. 4, the layers of the mattress topper 230 are connected by a plurality of tufts 280 that extend through all of the layers of the mattress topper 230. In particular, the exemplary mattress topper 230 shown in FIG. 4 also includes a plurality of coil springs 240 arranged in a matrix similar to the mattress toppers 30, 130 described above with reference to FIGS. 1-3. Furthermore, although not shown in the FIG. 4, the mattress topper 230 in FIG. 4 also includes an upper fabric layer extending above the plurality of coil springs 240, a lower fabric layer extending below the plurality of coil springs 240, a backing layer positioned below the lower fabric layer, a padded layer positioned atop the upper fabric layer, and a textile layer positioned atop the padded layer similar to the corresponding layers described above with reference to FIGS. 1-3. As shown in FIG. 4, however, the plurality of coil springs 240 are arranged in a rectangular matrix with a tuft 280 positioned at an intersection point equidistant to four adjacent coil springs 240 such that each coil spring 240 is bordered by four tufts 280 which connect all of the layers of the mattress topper 230 around each coil spring 240 to collectively form a fabric pocket encasing the coil spring 240 similar to the fabric pockets described above with respect to FIGS. 1 and 2.

Of course, rather than connecting all of the layers of the mattress topper with an ultrasonic weld or with a tuft, one or more of the layers of the mattress topper can be connected by an ultrasonic weld or tuft while the other layers are connected by an alternative means including, for example, a tuft, an adhesive, a staple, stitches, clamps, hook-and-loop fasteners, and the like. For example, in some embodiments, a lower fabric layer, an upper fabric layer, and a padded layer are all connected by an ultrasonic weld around each coil spring, but a backing layer and a textile layer are connected by an adhesive to the respective underlying layers. Similarly, in other embodiments, a lower fabric layer, an upper fabric layer, and a padded layer are all connected by a tuft extending through the lower fabric layer, upper fabric layer, and padded layer, but a backing layer and a textile layer are connected by an adhesive to the respective underlying layers.

Regardless of how the various layers of the mattress topper are connected, in the mattress toppers of the present invention, the coil springs are integrated into the mattress topper such that they are held in position relative to the layers of the mattress topper as well as the other coil springs. Furthermore, the mattress topper itself is securely connected to the mattress core by means well known in the art. In this regard, the coils remain in place relative to the mattress core even when the mattress assembly is moved or otherwise manipulated. For example, in embodiments of the present invention where the mattress topper is positioned atop an adjustable mattress base, when the mattress assembly is actuated into, for example, a reclined position, each of the coil springs remains in place relative to the mattress core and continues to provide the same support to a user positioned on the mattress assembly.

Further provided by the present invention are methods for producing a mattress topper. In one exemplary implementation of a method for producing a mattress topper, such as the mattress toppers 30, 130, 230 described above, an array of coils is first provided. Each of the coils in the array is made of a continuous wire that extends from a lower end convolution to an upper end convolution opposite the lower end convolution. The array of coils is then positioned between an upper fabric layer and a lower fabric layer. In particular, the upper fabric layer is positioned such that it extends across the upper end convolutions of the coils and the lower fabric layer is positioned such that it extends across the lower end convolutions of the coils.

After positioning the array of coil springs between the upper fabric layer and the lower fabric layer, the lower fabric layer is then connected to the upper fabric layer between each of the coil springs. In particular, the lower fabric layer is connected to the upper fabric layer by ultrasonically welding the lower fabric layer to the upper fabric layer. As would be recognized by those of skill in the art, such ultrasonic welds are formed by compressing the fabric layers together between two irons and then running an electric current through the irons to melt the material of the two fabric layers together. In this regard, the upper fabric layer and the lower fabric layer are preferably made of a non-woven textile similar to the upper fabric layer 54 and the lower fabric layer 52 described above with respect to FIG. 1. Typically, ultrasonic welds are formed along a linear path with only a portion of the weld formed at any given moment. In some embodiments of the present invention, however, the step of ultrasonically welding the lower fabric layer to the upper fabric layer is performed by compressing the fabric layers between two substantially circular irons which fit around each coil spring such that the irons simultaneously form an ultrasonic weld that completely surrounds the respective coil spring.

After connecting the lower fabric layer to the upper fabric layer, a padded layer is then connected to the upper fabric layer. In some implementations of the method of the present invention, the padded layer is connected to the upper fabric layer by applying an adhesive to the upper fabric layer and then positioning the padded layer atop the upper fabric layer. For example, in some embodiments, this process is performed by roll feeding the array of coil springs positioned between the lower fabric layer and the upper fabric layer through a roll coater to roll coat the adhesive onto the upper fabric layer and then position the padded layer atop the upper fabric layer in one continuous process.

In some other implementations of the method of the present invention, the padded layer is connected to the upper fabric layer with an ultrasonic weld. For example, after connecting the lower fabric layer to the upper fabric layer, a padded layer is positioned atop the upper fabric layer and the lower fabric layer. The lower fabric layer, the upper fabric layer, and the padded layer are then compressed around each coil spring, and the lower fabric layer, the upper fabric layer, and the padded layer are ultrasonically welded around each coil spring. Of course, rather than connecting the padded layer to the upper fabric layer with an ultrasonic weld in a separate step performed after connecting the lower fabric layer to the upper fabric layer, the padded layer can be connected to the upper fabric layer with an ultrasonic weld simultaneously with the above described step of ultrasonically welding the lower fabric layer to the upper fabric layer.

In still other implementations of the methods of the present invention, the padded layer is connected to the upper fabric layer by forming a plurality of tufts that extend through the lower fabric layer, the upper fabric layer, and the padded layer. As would be recognized by those of skill in the art, in forming such tufts, a large needle is pushed through the lower fabric layer, the upper fabric layer, and the padded layer. According to some implementations of the method of the present invention, the needle is pushed through the lower fabric layer, the upper fabric layer, and the padded layer between each of the coils in order to form each of the plurality of tufts. It is contemplated that while pushing the needle through the lower fabric layer, the upper fabric layer, and the padded layer, unintended contact between the large needle and a coil spring may occur. Advantageously, the large needle will simply push the coil spring out of the way during insertion rather than bending or breaking the needle.

Regardless of the particular method utilized to connect the padded layer, it is contemplated that upon connecting the padded layer, the resulting mattress topper can then be connected to a mattress core as part of a mattress assembly. Furthermore, it should be understood that additional steps of connecting more layers, such as the backing layer and textile layer described above with respect to FIG. 1, may also be included in the implementations of the methods of the present invention. Such additional layers may be connected by adhesives, ultrasonic welds, or tufts by methods substantially similar to the methods of connecting the padded layer described above.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A mattress assembly, comprising:

a mattress core having a bottom surface and a top surface opposite the bottom surface; and a mattress topper positioned adjacent and connected to the top surface of the mattress core, the mattress topper including:

a plurality of coil springs, an upper fabric layer extending above the plurality of coil springs, a lower fabric layer extending below the plurality of coil springs and connected to the upper fabric layer around each coil spring by a plurality of overlapping welds such that the upper fabric layer and the lower fabric layer collectively form a fabric pocket encasing each coil spring, a padded layer positioned atop and connected to the upper fabric layer, wherein the padded layer is comprised of a visco-elastic foam, a fibrous material, or both a visco-elastic foam and a fibrous material, a textile layer on a top surface of said padded layer, a backing layer disposed along a bottom surface of said lower fabric layer, wherein said upper fabric layer is connected to the lower fabric layer by said plurality of overlapping welds, said backing layer is connected to said lower fabric layer by said plurality of overlapping welds, said padded layer is connected to said upper fabric layer by the plurality of overlapping welds, and the textile layer is connected to the padded layer by said plurality of overlapping welds.

2. The mattress assembly of claim 1, wherein the padded layer is comprised of a visco-elastic foam.

3. The mattress assembly of claim 1, wherein the padded layer is comprised of a plurality of layers.

4. The mattress assembly of claim 1, wherein the upper fabric layer, the lower fabric layer, or both are comprised of a non-woven textile.

5. The mattress assembly of claim 1, wherein the lower fabric layer is connected to the upper fabric layer by an ultrasonic weld.

6. The mattress assembly of claim 1, wherein the padded layer is connected to the upper fabric layer by an ultrasonic weld.

7. The mattress assembly of claim 1, wherein the padded layer is connected to the upper fabric layer by an adhesive.

8. The mattress assembly of claim 1, wherein the padded layer is connected to the upper fabric layer by a plurality of tufts that extend through the lower fabric layer, the upper fabric layer, and the padded layer.

9. The mattress assembly of claim 1, wherein the mattress topper further includes a textile layer positioned atop the padded layer.

10. The mattress assembly of claim 1, wherein the backing layer is comprised of a non-woven textile.

11. A method of producing a mattress topper for connection to a mattress core, comprising the steps of:

providing an array of coil springs;

positioning the array of coil springs between an upper fabric layer and a lower fabric layer;

connecting the lower fabric layer to the upper fabric layer between each coil spring with a plurality of overlapping welds;

connecting a backing layer to said lower fabric layer by said plurality of overlapping welds;

connecting a padded layer to said upper fabric layer by the plurality of overlapping welds;

connecting the textile layer to the padded layer by said plurality of overlapping welds.

12. The method of claim 11, wherein the step of connecting the lower fabric layer to the upper fabric layer comprises ultrasonically welding the lower fabric layer to the upper fabric layer.

13. The method of claim 12, wherein the step of ultrasonically welding the lower fabric layer to the upper fabric layer is performing by positioning a circular iron around each said coil spring of the array of coil springs such that the iron simultaneously forms an ultrasonic weld completely surrounding each said coil spring.

14. The method of claim 11, further comprising a step of connecting a padded layer to the upper fabric layer.

15. The method of claim 14, wherein the step of connecting the padded layer to the upper fabric layer comprises roll coating the upper fabric layer with an adhesive and positioning the padded layer atop the upper fabric layer.

16. The method of claim 14, wherein the step of connecting the padded layer to the upper fabric layer comprises:

positioning the padded layer atop the upper fabric layer;

compressing the lower fabric layer, the upper fabric layer, and the padded layer around each coil spring; and ultrasonically welding together the lower fabric layer, the upper fabric layer, and the padded layer around each coil spring.

17. The method of claim 14, wherein the step of connecting the padded layer to the upper fabric layer comprises forming a plurality of tufts extending through the lower fabric layer, the upper fabric layer, and the padded layer.

18. A mattress topper, comprising:

a plurality of coil springs, an upper fabric layer extending above the plurality of coil springs, and a lower fabric layer extending below the plurality of coil springs and connected to the upper fabric layer by an overlapping weld around each coil spring of said plurality of coil springs such that the upper fabric layer and the lower fabric layer collectively form a fabric pocket encasing each of said coil spring;

a padded layer positioned atop the upper fabric layer, said padded layer comprising a visco-elastic foam, or a fibrous material, or both a visco-elastic foam and a fibrous material;

a textile layer positioned atop the padded layer; and a backing layer positioned below the lower fabric layer, wherein said upper fabric layer is connected to the lower fabric layer by said overlapping welds, said backing layer is connected to said lower fabric layer by said overlapping welds, said padded layer is connected to said upper fabric layer by the overlapping welds, and the textile layer is connected to the padded layer by said overlapping welds.

19. The mattress topper of claim 18, further comprising a plurality of tufts that extend through the lower fabric layer, the upper fabric layer, and the padded layer.

20. The mattress topper of claim 19, wherein the plurality of tufts also extend through the backing layer, the textile layer, or both the backing layer and the textile layer.

* * * * *